US008468732B2

(12) United States Patent
Young

(10) Patent No.: US 8,468,732 B2
(45) Date of Patent: Jun. 25, 2013

(54) TRIGGER ASSEMBLY

(76) Inventor: Nicholas E. Young, Murray, UT (US)

( * ) Notice: Subject to any disclaimer, the term of this patent is extended or adjusted under 35 U.S.C. 154(b) by 425 days.

(21) Appl. No.: 12/688,706

(22) Filed: Jan. 15, 2010

(65) Prior Publication Data

US 2010/0175292 A1 Jul. 15, 2010

Related U.S. Application Data

(60) Provisional application No. 61/145,084, filed on Jan. 15, 2009.

(51) Int. Cl.
*F41A 17/00* (2006.01)

(52) U.S. Cl.
USPC ..... 42/70.06; 42/70.01; 89/142

(58) Field of Classification Search
USPC ..... 42/70.06, 70.01; 89/142
See application file for complete search history.

(56) References Cited

U.S. PATENT DOCUMENTS

| | | | | | |
|---|---|---|---|---|---|
| 1,070,965 | A * | 8/1913 | Jones | 42/70.01 |
| 1,091,190 | A * | 3/1914 | Castle | 42/70.06 |
| 1,360,950 | A * | 11/1920 | Herren | 42/70.06 |
| 1,520,671 | A * | 12/1924 | Rosier | 89/146 |
| 2,000,858 | A * | 5/1935 | Maxwell | 42/70.06 |
| 2,189,202 | A * | 2/1940 | Garland | 89/139 |
| 2,379,946 | A * | 7/1945 | Baker | 42/70.06 |
| 2,635,379 | A * | 4/1953 | Baker et al. | 42/70.01 |
| 2,874,503 | A * | 2/1959 | Niesp | 42/70.06 |
| 3,713,242 | A * | 1/1973 | Seifried | 42/70.06 |
| 4,002,101 | A * | 1/1977 | Tellie | 89/142 |
| 4,136,475 | A * | 1/1979 | Centille | 42/70.11 |
| 4,754,568 | A * | 7/1988 | Brandt | 42/70.06 |
| 5,024,017 | A * | 6/1991 | Nishioka | 42/70.07 |
| 5,465,517 | A * | 11/1995 | Garofalo | 42/70.06 |
| 5,560,135 | A * | 10/1996 | Ciluffo | 42/70.07 |
| 5,784,818 | A * | 7/1998 | Otteson | 42/70.04 |
| 6,223,460 | B1 * | 5/2001 | Schmitter et al. | 42/70.06 |
| 6,519,888 | B1 * | 2/2003 | Oberst | 42/70.11 |
| 7,339,456 | B1 * | 3/2008 | Buckley et al. | 340/5.51 |

* cited by examiner

*Primary Examiner* — Michelle Clement

(57) ABSTRACT

A trigger assembly including a housing having an upper portion, a lower portion, a front portion, a rear portion, a first side portion and a second side portion. A recess is defined in the housing between the upper portion and the lower portion. First and second guide channels are defined in the first side portion and the second side portion respectively. A trigger lever is configured to pivot within the housing about a pivot point positioned at least partially within the housing, the trigger lever having a body, a trigger bar extending in a first direction from the body, and a safety bar extending in a section direction from the body. A safety mechanism includes a first guide rail, a second guide rail spaced apart from the first guide rail, and a blocking member extending between the first guide rail and the second guide rail.

6 Claims, 2 Drawing Sheets

TRIGGER ASSEMBLY

CROSS-REFERENCE TO A RELATED APPLICATION

The present application claims the benefit of prior U.S. Provisional Patent Application Ser. No. 61/145,084 filed Jan. 15, 2009 and entitled "Trigger Assembly," which is incorporated herein by reference in its entirety.

BACKGROUND

1. The Field of the Invention

The present application generally relates to trigger assemblies for firearms. In particular this application discusses safety mechanisms for use in firearms.

2. The Relevant Technology

Modern firearms make use of cartridges that include a projectile seated in a casing. The casing has an internal cavity defined therein that contains a charge of rapidly combusting powder. A primer is seated in a recess formed in a rear portion of the casing. A hole in the primer casing places the primer in communication with the internal cavity containing the power. A projectile is seated in the front portion of the casing such that the powder is more or less sealingly contained in the casing between the primer and the projectile.

An action, such as a bolt action, is used to fire the cartridge. For example, the action can include a striker that carriers a firing pin. The striker can be coupled to a biasing member, such as a spring. The spring provides a motive force for the striking to cause the firing pin to impact the primer. More specifically, the spring can be compressed, or cocked, by drawing the striker rearwardly. Engagement between a sear and the striker can maintain the striker in a cocked position.

The action can then be used to advance the cartridge into a firing chamber ahead of firing. While in the firing chamber, a trigger mechanism can be used to release the sear to cause the firing pin to strike the primer, causing the primer to ignite. The ignition is directed to the powder, which burns within the casing. The powder burns within the casing to generate a rapidly expanding gas, which propels the projectile out of the casing and through the barrel.

Safety mechanism are often used that are rotated into engagement with the trigger mechanism to prevent the trigger mechanism from releasing the sear. Though such configurations may block the movement of the trigger, such safeties often rely on a large amount of interference between the safety mechanism and the trigger. Some of this friction may be present when the trigger is pulled, resulting in unintended drag on the trigger.

The subject matter claimed herein is not limited to embodiments that solve any disadvantages or that operate only in environments such as those described above. Rather, this background is only provided to illustrate one exemplary technology area where some examples described herein may be practiced.

BRIEF SUMMARY OF THE INVENTION

A trigger assembly including a housing having an upper portion, a lower portion, a front portion, a rear portion, a first side portion and a second side portion. A recess is defined in the housing between the upper portion and the lower portion. First and second guide channels are defined in the first side portion and the second side portion respectively. A trigger lever is configured to pivot within the housing about a pivot point positioned at least partially within the housing, the trigger lever having a body, a trigger bar extending in a first direction from the body, and a safety bar extending in a section direction from the body. A safety mechanism includes a first guide rail, a second guide rail spaced apart from the first guide rail, and a blocking member extending between the first guide rail and the second guide rail. Translation of the first and second guide rail relative to the housing moves the blocking member between a safe position in which the blocking member engages the safety bar to block rotation of the trigger lever and a fire position in which the blocking member is disengaged from the safety bar.

The blocking member may engage the safety mechanism at a distance of between about 0.8 inches and about 1.2 inches from the pivot point when the blocking member is in the safe position. A first distance from a pivot axis of the pivot guide to an end of the safety bar is between about 1.5 and 2.5 times greater than a second distance (from a pivot axis to an end of the trigger bar). Further, the safety bar can have a length of between about 0.9 inches or less and about 1.4 inches or more. A ratio of the length of the safety bar to the trigger bar can be greater than one. For example, the ratio can be approximately 1.5:1 to about 2.1 or greater.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

A trigger assembly is provided herein that includes a trigger lever having a safety bar that extends forwardly of a pivot point of the trigger lever. The trigger lever pivots within a housing to allow a trigger bar portion of the trigger lever to act to release a sear, which releases a striker from a cocked position to cause the striker to impact a primer on a cartridge to fire a projectile. A safety mechanism is slidingly coupled to the housing and moves between a fire position and a safe position. In the fire position, the safety mechanism allows the trigger lever to rotate freely relative to the housing. In the safe position, the safety mechanism engages the safety bar of the trigger lever, thereby inhibiting or blocking rotation of the trigger lever.

In at least one example, the blocking member engages the safety bar at a relatively large distance from the pivot point. Further, in at least one example, a distance from the pivot point at which the blocking member engages the safety device can be greater than the distance between the pivot point and the end of the trigger bar. In such a configuration, a relatively large force can be required to overcome engagement between the safety bar and the blocking member due to the relatively large moment arm provided by the length of the safety bar. Such a configuration can help reduce unintended movement of the trigger lever while the safety mechanism is in the safe position.

A trigger assembly is described below with reference to a single action type firearm. It will be appreciated that the trigger assembly, and the safety mechanism in particular, can be implemented in firearms having other types of actions, such as double action or single/double action type mechanisms. Various terms will be used to described the relative positions of components, including above, below, forward, rearward, and other similar terms. It will be appreciated that the forward and rearward directions are generally parallel to the barrel of the firearm, regardless of the orientation relative to horizontal and that above and below are generally perpendicular to the forward and rearward directions. These descriptions are provided for ease of reference only and should be not be construed as limiting.

Figure 1A:
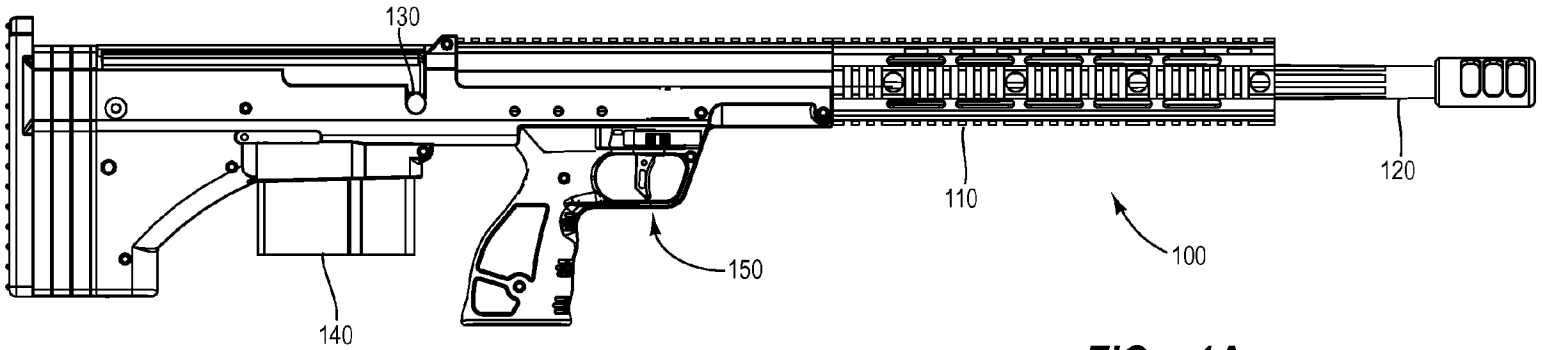
FIG. 1A illustrates a side view of a rifle in which a trigger assembly can be implemented according to one example.

FIG. 1 illustrates a perspective view of a firearm system 100 according to one example that includes a stock 110, a barrel 120, an action 130, and a magazine 140. The action 130 is operatively associated with the barrel 110. In the illustrated example, a bolt-type action is shown. It will be appreciated that in other examples, other types of actions, such as pump-type actions, recoil-operated actions, gas-operated actions, as well as any other type of actions can be used in connection with a trigger assembly 150.

Regardless of the type, cycling of the action 130 moves a cartridge into position to be fired and removes the casing after the cartridge has been fired. For example, forward operation of the action 130 can move a cartridge through a breech and into position with the barrel 130. Thereafter, the trigger assembly 150 can be actuated to release a sear from a striker carrying a firing pin in the action 130. The firing pin (not shown) strikes a primer, which ignites gun powder in a casing to propel a projectile through the barrel 120.

Figure 1B:
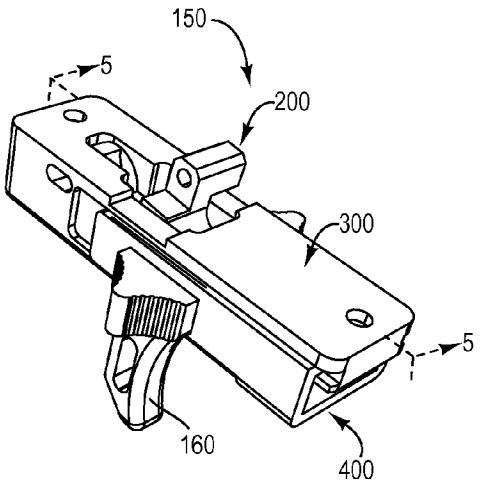
FIG. 1B illustrates the trigger assembly of FIG. 1A in more detail.

FIG. 1B illustrates an isolated, perspective view of the trigger assembly 150 in more detail. As illustrated in FIG. 1B, the trigger assembly 150 generally includes a trigger lever 200 housed partially within and rotatingly coupled to a housing 300. A trigger 160 is coupled to the trigger lever 200. In the illustrated example, the trigger 160 is shown as being removably coupled to the trigger lever 200. It will be appreciated that the trigger 160 can be integrally formed with the trigger lever 200, permanently coupled thereto, or have any other configuration as desired.

A safety mechanism 400 is coupled to the housing 300 and is configured to translate between a safe position and a fire position. In a safe position, the safety mechanism 400 is located at a position on the housing 300 that inhibits or blocks the trigger lever 200 from rotating a sufficient amount to release a sear. In a fire position, the safety mechanism 400 is located at a position on the housing 300 that allows the trigger lever 200 to rotate freely from the safety mechanism 400 and thereby allows rotation of the trigger lever 200 to release a sear.

Figure 2:
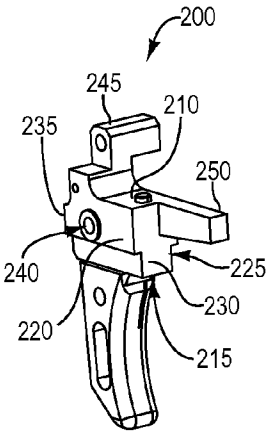
FIG. 2 illustrates a perspective view of trigger lever that can be implemented in a trigger assembly according to one example.
Figure 5A:
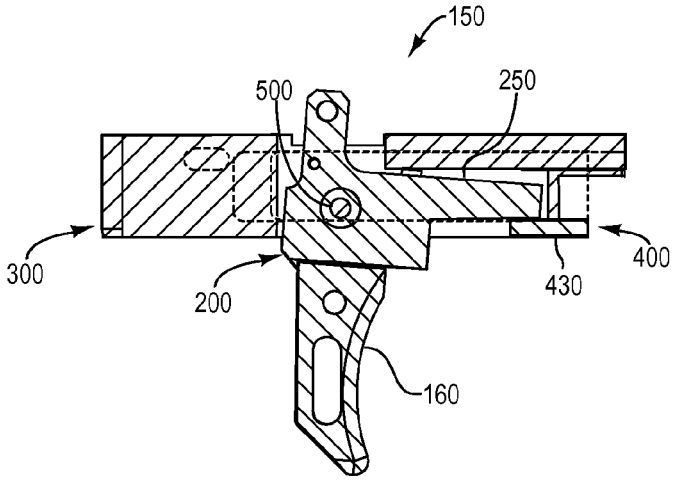
FIG. 5A illustrates a cross-sectional view of a trigger assembly in which a safety mechanism is in a safe position according to one example.

FIG. 2 illustrates the trigger lever 200 in more detail. As illustrated in FIG. 2 the trigger lever 200 generally includes an upper portion 210, a lower portion 215, opposing side portions 220, 225, a front portion 230, and a rear portion 235. A pivot guide hole 240 is formed in the trigger lever that extends through the opposing side portion 220, 225. The pivot guide hole 240 is configured to receive a corresponding pivot 500 (FIG. 5A). As a result, the trigger lever 200 pivots about the pivot guide hole 240.

A trigger bar 245 extends from the trigger lever 200. In particular, the trigger bar 245 is oriented relative to and offset from the pivot guide hole 240 such that rotation of the trigger lever 200 about the pivot guide hole 240 causes the trigger bar 245 to move in such a manner as to release a sear. As a result, rotation of the trigger lever 205 allows the trigger bar 245 to release a sear.

In the illustrated example, a safety bar 250 extends forwardly from the trigger lever 200. The trigger bar 245 and the safety bar 250 may be rigidly coupled to the trigger lever 200 such that they rotate together. In at least one example, the safety bar 250 can have a length of between about 0.9 inches or less and about 1.4 inches or more as measured along a distance perpendicular to an axis of rotation of the pivot guide hole 240 to an end of the safety bar. In at least one example, the safety bar 250 may be oriented at an angle relative to the trigger bar 245. In further examples, the safety bar 250 may be generally perpendicular to the trigger bar 245. In at least one example, a ratio of the length of the safety bar 250 to the trigger bar 245 can be greater than one. For example, the ratio can be approximately 1.5:1 to about 2:1 or greater.

As will be discussed in more detail below, the trigger lever 200 is pivotally coupled to the housing 300 while the safety mechanism 400 is slidingly coupled to the housing 300. The configuration of the housing 300 will now be discussed in more detail, followed by a discussion of the safety mechanism 400.

Figure 3:
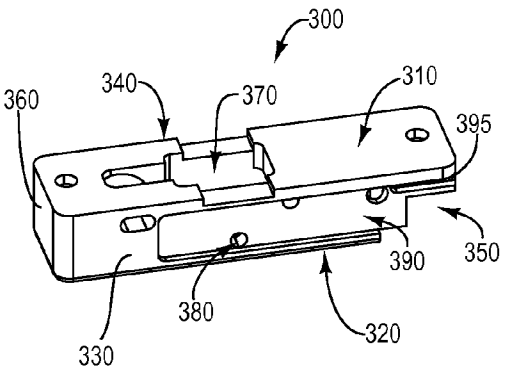
FIG. 3 illustrates a perspective view of housing that can be implemented in a trigger assembly according to one example.

FIG. 3 illustrates a perspective view of the housing 300. The housing 300 generally includes an upper portion 310, a lower portion 320, opposing sides 330, 340, a front portion 350, and a rear portion 360. A recess 370 is defined in the housing 300 that extends from the upper portion 310 through the lower portion 320. The recess 370 is configured to receive at least a portion the trigger lever 200 (FIG. 2).

As shown in FIG. 3, pivot holes 380 are defined in the opposing side portions 330, 340. The pivot guide hole 240

(FIG. 2) may be aligned with the pivot holes 380 to allow a pivot (500, FIG. 5A) to be passed through side portion 330, through the trigger lever 200 of the trigger lever 200 (both seen in FIG. 2), and into opposing side portion 340. With the pivot (500, FIG. 5A) thus positioned, the trigger lever 200 is able to rotate relative to the housing 300. As briefly introduced and as will be discussed in more detail below, rotation of the trigger lever 200 (FIG. 2) relative to the housing 300 allows the trigger lever 200 to release a sear.

As also previously introduced, the housing 300 is configured to cooperate with the safety mechanism 400 (FIG. 4) to allow the safety mechanism 400 to selectively block rotation of the guide member 400. In at least one example, the housing 300 includes guide channels 390 and guide slots 395 defined in the opposing side portions 330, 340 respectively. In the illustrated example, the housing 300 has a major axis parallel to the opposing sides 330, 340 and a minor axis perpendicular to the major axis. As shown in FIGS. 5A and 5B, the safety mechanism 400 moves parallel to the major axis as it translates between the safe position and the fire position.

Figure 4:
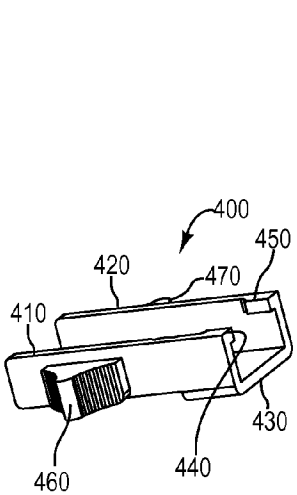
FIG. 4 illustrates a perspective view of safety slide that can be implemented in a trigger assembly according to one example.
Figure 5B:
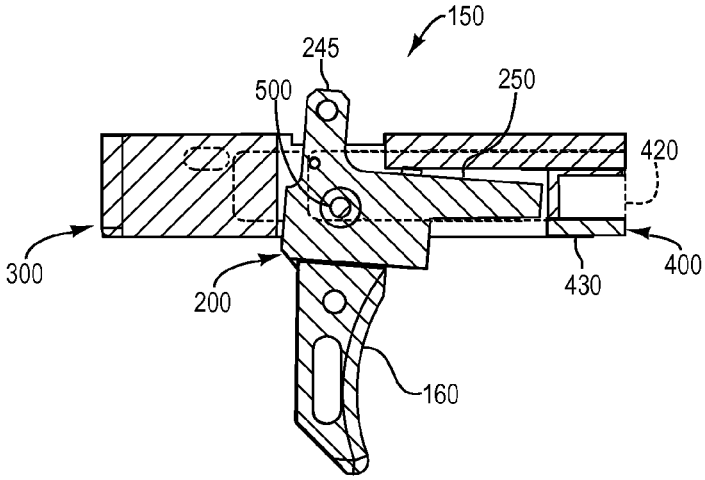
FIG. 5B illustrates a cross-sectional view of a trigger assembly in which a safety mechanism is in a fire position according to one example.

FIG. 4 illustrates a perspective view of the safety mechanism 400 in more detail. As shown in FIG. 4, the safety mechanism 400 includes opposing, spaced-apart guide rails 410, 420 configured engage the guide channels 390 (FIG. 3) as well as tabs 440, 450 configured to engage guide slots 395. The safety mechanism 400 also includes a blocking member 430 that extends between the guide rails 410, 420. Such a configuration allows the guide channels 390 (FIG. 3) to guide the safety mechanism 400 as the safety mechanism 400 translates relative to the housing 300 (FIG. 3). As the guide rails 410, 420 translate relative to the housing 300, the guide rails 410, 420 position the blocking member 430 at a desired position under the housing 300 and relative to the trigger lever 200 (FIG. 2). These positions may include a safe position and a fire position.

Further, as shown in FIG. 4 the safety mechanism 400 includes protrusions 460, 470 that extend outwardly from the guide rails 410, 420. The protrusions 460, 470 can help facilitate movement of the safety mechanism 400 between the safe position and the fire position. The safe and fire positions will now be discussed in more detail.

FIG. 5A illustrates a cross-sectional view of the trigger assembly 150 taken along section 5-5 of FIG. 1B. In general, a force applied to the trigger 160 to move the trigger 160 in a rearward direction would cause the trigger lever 200, to which the trigger 160 is coupled, to rotate about the pivot 500.

As shown in FIG. 5A, when the safety mechanism 400 is in the safe position, the safety mechanism 400 is positioned relative to the housing 300 to place the blocking member 430 below a portion of the safety bar 250. While thus positioned, the blocking member 430 engages the safety bar 250 to prevent the trigger lever 200 from rotating. In at least one example, the blocking member 430 can engage the safety bar 250 at a distance of between about 0.8 inches or less and about 1.2 inches or greater from the pivot 500.

As shown in FIG. 5B, the safety mechanism 400 may be moved to the fire position by moving the guide rails 410, 420 (FIG. 4) forward relative to the housing 300. As the guide rails 410, 420 move forward, the blocking member 430 moves forward of the forward end of the safety bar 250. As a result, a rearward force acting on the trigger 160 causes the trigger lever 200 to pivot about the pivot 500 toward the position shown in FIG. 5C.

Figure 5C:
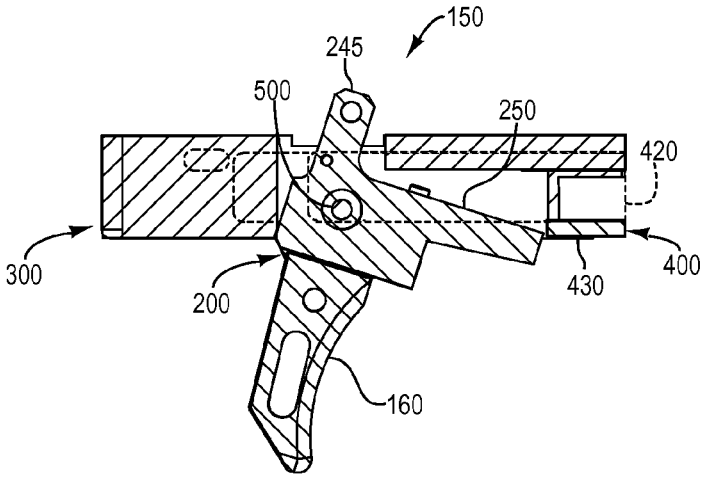
FIG. 5C illustrates a cross-sectional view of a trigger assembly in which a safety mechanism is in a fire position and the trigger has been rotated to a fire position according to one example.

As shown in FIG. 5C, as the trigger lever 200 pivots about the pivot 500, the safety bar 250 is able to move freely with respect to the safety mechanism 400 and the blocking member 430 in particular. FIGS. 5B and 5C illustrate that the trigger bar 245 is offset from the pivot 500 such that rotation of the trigger lever 245 causes the trigger bar 245 to extend a greater distance from the upper portion 310 of the housing 300 while the trigger 160 is positioned as shown in FIG. 5C than when the trigger 160 is positioned as shown in FIG. 5B. If the trigger assembly 200 is coupled to an action, as the trigger bar 245 is thus moved upwardly from the housing 300, the trigger bar 245 may release the sear to thereby cause the action to fire. In at least one example, the trigger bar 245 may be coupled to the sear by way of a transfer bar. In such an example, rotation of the trigger lever 200 causes the trigger bar 245 to move the transfer bar, which in turn moves to release the sear.

A trigger assembly has been discussed herein that includes a trigger lever having a safety bar that extends forwardly of a pivot point of the trigger lever. The trigger lever pivots within a housing to allow a trigger bar portion of the trigger lever to move a transfer bar to release a sear, which releases a striker from a cocked position to cause the striker to impact a primer on a cartridge to fire a projectile. A safety mechanism is slidingly coupled to the housing and moves between a fire position and a safe position. In the fire position, the safety mechanism allows the trigger lever to rotate freely relative to the trigger lever. In the safe position, the safety mechanism engages the safety bar of the trigger lever, thereby inhibiting or blocking rotation of the trigger lever.

In at least one example, the blocking member engages the safety bar at a relatively large distance from the pivot point. Further, in at least one example, a distance from the pivot point at which the blocking member engages the safety device can be greater than the distance between the pivot point and the end of the trigger bar. In such a configuration, a relatively large force can be required to overcome engagement between the safety bar and the blocking member due to the relatively large moment arm provided by the length of the safety bar. Such a configuration can help reduce unintended movement of the trigger lever while the safety mechanism is in the safe position.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A trigger assembly, comprising:

a housing having an upper portion, a lower portion, a front portion, a rear portion, a first side portion and a second side portion, wherein a recess is defined in the housing between the upper portion and the lower portion and wherein first and second guide channels are defined in the first side portion and the second side portion respectively:

a trigger lever configured to pivot within the housing about a pivot point positioned at least partially within the housing, the trigger lever having a body, a trigger bar extending in a first direction from the body, and a safety bar extending in a second direction from the body; and a safety mechanism, the safety mechanism having a first guide rail, a second guide rail spaced apart from the first guide rail, and a blocking member extending between the first guide rail and the second guide rail, the first guide rail being translatingly coupled to the first guide channel and the second guide rail being translatingly coupled to the second guide channel, wherein translation of the first and second guide rails relative to the housing moves the blocking member between a safe position in which the blocking member engages the safety bar to block rotation of the trigger lever and a fire position in which the blocking member is disengaged from the safety bar, wherein pivoting of the trigger lever rotates at least a portion of the safety bar toward the lower portion of the housing and wherein pivoting of the trigger lever rotates a lower portion of the safety bar beyond the lower portion of the housing while the safety mechanism is in the first position and the blocking member is configured to be positioned below an adjacent region of the lower portion of the housing while the blocking mechanism is in the safe position.

2. The trigger assembly of claim 1, wherein the first guide rail and the second guide rail are parallel to each other.

3. The trigger assembly of claim 1, wherein the blocking member is positioned adjacent the front end of the housing when the blocking member is in the fire position.

4. The trigger assembly of claim 1, wherein the blocking member engages the safety mechanism at a distance of between about 0.8 inches and about 1.8inches from the pivot point when the blocking member is in the safe position.

5. The trigger assembly of claim 1, wherein the housing has a major axis and a minor axis and wherein movement of the safety mechanism between the safe position and the fire position is parallel to the major axis.

6. The trigger assembly of claim 1, wherein the safety bar extends forwardly from the body.

* * * * *